United States Patent [19]

Dougherty

[11] 4,168,010

[45] Sep. 18, 1979

[54] IMPLOSION PROTECTED COLOR CATHODE RAY TUBE BULB AND BULB COMPONENTS

[75] Inventor: Lawrence W. Dougherty, Sleepy Hollow, Ill.

[73] Assignee: Zenith Radio Corporation, Glenview, Ill.

[21] Appl. No.: 772,891

[22] Filed: Feb. 28, 1977

[51] Int. Cl.[2] ..... H01J 29/87; H01J 61/32; H01K 1/28

[52] U.S. Cl. ..... 220/2.1 A; 29/446; 220/71; 358/247; 427/106; 427/423

[58] Field of Search ..... 220/2.1 A, 2.3 A, 71; 358/245, 246, 247; 228/121; 403/273; 65/43; 29/447, 446; 427/168, 106, 423

[56] References Cited

U.S. PATENT DOCUMENTS

| | | | |
|---|---|---|---|
| 819,624 | 5/1906 | Wood | 403/273 X |
| 3,153,839 | 10/1964 | Pakswer | 228/121 |
| 3,162,933 | 12/1964 | Trax et al. | 29/447 X |
| 3,222,206 | 12/1965 | Cornelissen et al. | 427/106 X |
| 3,332,569 | 7/1967 | Spear | 220/2.1 A |
| 3,403,805 | 10/1968 | Powell et al. | 65/43 X |
| 3,471,317 | 10/1969 | Clock | 220/2.1 A X |
| 3,519,161 | 7/1970 | Powell et al. | 220/2.1 A |
| 3,725,718 | 4/1973 | Quirk et al. | 427/423 X |
| 3,996,491 | 12/1976 | Larson et al. | 358/246 X |
| 4,029,898 | 6/1977 | Belentepe | 220/2.1 A X |

FOREIGN PATENT DOCUMENTS

| | | | |
|---|---|---|---|
| 688121 | 2/1953 | United Kingdom | 220/1 A |

*Primary Examiner*—Allan N. Shoap
*Attorney, Agent, or Firm*—John H. Coult

[57] ABSTRACT

This application depicts a color cathode ray tube bulb and bulb components having a novel protection system, and a method of installation. In one embodiment disclosed, a color CRT bulb comprises a glass faceplate hermetically sealed to a glass funnel along a sealing interface. The bulb is characterized by having a particle-deposited, high tensile strength, form-fitting bondment composed of a material having a high yield strength and Young's modulus. The bondment engirds and is self-adhered to the bulb at or near the sealing interface so as to become one therewith. The bondment is built up to such cross-sectional dimensions as to have sufficient strength and stiffness to provide implosion protection for the bulb by confining and restraining the shards of a fractured bulb. In a preferred execution the bondment applies a compressive pre-load to the bulb. Also depicted are applications of a bondment to funnel and faceplate components before they are assembled into a complete bulb.

9 Claims, 11 Drawing Figures

IMPLOSION PROTECTED COLOR CATHODE RAY TUBE BULB AND BULB COMPONENTS

CROSS REFERENCE TO RELATED APPLICATIONS

This application relates to but is not dependent upon, copending applications of common ownership herewith, including Ser. No. 623,854, filed Oct. 20, 1975 (now U.S. Pat. No. 4,021,850, issued May 3, 1977); Ser. No. 639,741, filed Dec. 11, 1975 (now U.S. Pat. No. 4,037,255, issued July 19, 1977); Ser. No. 623,853, filed Oct. 20, 1975 (now U.S. Pat. No. 4,016,364, issued Apr. 5, 1977); Ser. No. 632,559, filed Nov. 17, 1975 (now U.S. Pat. No. 4,012,773, issued Mar. 15, 1977); Ser. No. 718,631, filed Aug. 30, 1976 (now U.S. Pat. No. 4,084,193, issued Apr. 11, 1978).

BACKGROUND OF THE INVENTION

This invention relates to structures for protecting color television picture tube bulbs, and bulb components, from implosion, primarily. A conventional color television picture tube has an evacuated glass bulb which includes a faceplate with a rearward flange and a funnel sealed to the faceplate flange along a planar sealing interface. The faceplate has a concave inner surface upon which is deposited a luminescent phosphor screen. Due to the high vacuum in the bulb, several tons of atmospheric pressure are exerted on the faceplate and funnel, causing the bulb to be susceptible to implosion. (The term "implosion" is defined by Underwriters Laboratory Incorporated as a "rapid and sudden inward bursting of a high-vacuum glass envelope.") It is of the utmost importance in the interest of safety to prevent the bulb from violently imploding should it, for example, be struck by a heavy missile.

There have evolved a number of approaches to implosion protecting color CRT's (cathode ray tubes) of the described type having a conventional bulb (with a flanged faceplate). A first approach seeks to confine or restrain the shards of a fractured bulb. One type of system which implements this approach is referred to as a "rimbond" system. FIG. 1 shows schematically a color CRT bulb including a faceplate 1 of the conventional (flanged) type on which is mounted a rimbond implosion system. The rimbond system includes a scalloped metal frame 2 which surrounds the flange 3. A small gap provided between the frame 2 and the faceplate flange 3 is filled with a cement 4—typically an epoxy resin. In a rimbond system, the frame is not under tension. The cemented frame confines the glass shards 5 of a shattered faceplate long enough to permit gradual (and therefore nonviolent) devacuation of the bulb. If, however, the amount and distribution of cement is not just right, or the structural integrity or design of the frame is deficient, the periphery of the bulb will not be adequately confined. Upon application of an impact force to the faceplate ("F" in FIG. 1), the periphery of the faceplate moves outwardly (distance "a" in FIG. 1), permitting the shards 5 of a fractured faceplate to rapidly unlock and collapse inwardly (FIG. 2). The result is apt to be a violent implosion of the bulb.

Although the mechanics of implosions in television cathode ray tube bulbs are not fully understood, it is known that the strength, and the stiffness of the frame—(bending and torsional stiffness, as well as hoop stiffness) is very important to the achievement of implosion protection. Secondly, and perhaps of even greater importance, is the structural coupling between the frame and the bulb. As noted, in a rimbond system, retention of shards to prolong devacuation is indispensable. If shards are permitted to move relative to the frame or each other, they are apt to rapidly unlock and collapse. Even if we assume the frame to be immovable (which it isn't), if the loads (radial and axial, primarily) and moments exerted by the shards upon implosion are but weakly coupled to the frame through a relatively soft cement, a violent implosion is apt to result.

Structural coupling is achieved in rimbond systems by the cement introduced between the frame and the bulb. The bond strength of epoxy to glass (an important factor in the structural coupling between frame and bulb) is not as great as desired, particularly as the epoxy ages. Nevertheless, epoxy-type cements, in spite of their very high cost and degradation upon aging, are the most commonly used materials.

It is believed that if each frame could be custom fitted to its associated bulb, thereby minimizing the amount of cement required, better implosion protection might be achieved. This is because the cement (typically an epoxy) with a Young's modulus of only a few hundred thousand psi, unfortunately has a cushioning effect on implosion-induced loads on the frame. Form-fitting each frame to a particular bulb is, however, ruled out by its prohibitive cost. In practice, the frame is sized to be slightly larger than the largest (relative to "bogie" or nominal) bulb. Thus the cement-fitted gap between the frame and the smaller bulbs (relative to bogie) is quite large. This fact results in production tubes necessarily having cement thickness larger, on the average, than might be desirable to achieve the best possible implosion protection.

The cost of the frame, and particularly of the epoxy cement, are obvious drawbacks to rimbond systems. Also, such systems significantly enlarge the size of the bulb and tend to have less long term reliability (due to degradation of the epoxy cement) than is desirable. Exemplary U.S. patents illustrating rimbond systems are U.S. Pat. Nos. 3,485,407; 3,558,818; 3,412,203 and 3,835,250.

A second basic implosion protection approach involves placing a high compressive pre-load on the bulb. FIG. 3 is a highly schematic and exaggerated depiction of a "tension band" execution of this second basic approach; FIG. 3 is a sectional view along a diagonal. In FIG. 3 a tension band 8 is placed on the faceplate under very high tensive load—e.g. 1500–2000 pounds. The broken lines represent the faceplate configuration before pre-load; the amount of pre-load shown in FIG. 3 is exaggerated. It is common to underlie the band 8 with a layer 9 of tape (friction, vinyl, or the like) to cushion mold lines or other irregularities in the glass. Since all faceplates today are rectangular, most of this load is applied in the corner regions of the faceplate. The operation is not primarily one of confinement, as in rimbond systems, but one of pre-stress. By compressively preloading the faceplate corners, the implosion-induced tensive stresses in the faceplate must first overcome the compressive pre-stresses in the faceplate before the faceplate will fracture.

This latter approach is popular commercially because of its low cost, but has a number of shortcomings. It suffers from a criticality in placement of the band. E.g., a misplacement of the band of one-eighth inch may destroy the implosion protectability of a tension band system. It suffers also from its complete impotence when applied to bulbs of certain sizes and configurations. Like rimbond systems (but to a lesser degree), tension band systems add undesirable bulk to the finished bulb. Structural coupling of the band 8 to the bulb is nonexistent or very slight at all loads on the bulb periphery except the corners, and even there it is reduced somewhat by the cushioning effect of the underlying layer 9. Numerous patents have been issued on various aspects of tension band systems; e.g. U.S. Pat. Nos. 3,818,557; 3,456,076, 3,556,306; 3,597,537; 3,777,057; 3,845,530; and 3,890,464.

Another approach to implosion-protecting color CRT's with conventional faceplates involves the use of a two-part frame and a tension band to constrain the frame. The frame comprises a pair of "C"-shaped half frames. A viscous cement (an epoxy, typically) is usually applied to each of the half-frames; the half-frames are then placed around the faceplate flange with their ends abutting or overlapping. Before the cement has set, a tension band is drawn up tightly around the frame and faceplate flange. It is common to use a lighter weight tension band than is used in a pure tension band system.

In such systems, the primary attribute of a tension band (pre-loading of the faceplate) is lessened by the cushioning effect of the underlying cement and half-frames. The systems have elements of cost of both rimbond and tension band systems, and are thus more costly than tension band systems, but do not fully utilize the implosion protection principle of either. For an example of this latter type of system, see U.S. Pat. No. 3,845,530.

Yet another basic approach utilizes a secondary faceplate which is bonded over the outer surface of the functional faceplate so that should a destructive impact occur, the two faceplates fracture with their own random pattern of cracks. The result is an overlapping of bonded-together shards which very effectively restrain the scattering of glass. The major disadvantage of this secondary faceplate system is, however, its very high cost.

U.S. Pat. No. 3,647,960—Takemoto et al discloses still another implosion protection system for a color CRT of the type having a conventional bulb with a flanged faceplate. The implosion system of Takemoto et al comprises a series of closely spaced, mutually insulated turns of wire wrapped (with or without tension) around and adhered to the flange of the faceplate. See also Powell et al—U.S. Pat. No. 3,519,161 in this connection.

U.S. Pat. No. 3,166,211—Stel et al discloses an implosion protection system for a CRT which utilizes as one component a fiber-impregnated sheath on the exterior of the CRT bulb. Yet another implosion protection system for a conventional CRT bulb is disclosed in U.S. Pat. No. 3,220,593 in which a webbing material is glued to a substantial portion of the funnel and to the faceplate flange. A tension band is applied around the flange of the faceplate and over the webbing material. Other U.S. patents disclosing the use of a webbing material in an implosion protection system for a color CRT are U.S. Pat. Nos. 3,206,056 and 3,314,566.

This invention has application to color CRT's of the afore-described conventional type having a flanged faceplate. It also has application to a nonconventional color CRT bulb having a flangeless faceplate, as shown, e.g., in U.S. Pat. No. 3,912,963. The referent copending applications Ser. Nos. 639,741; 623,853; 623,954; 632,559; 718,631 and U.S. Pat. No. 4,004,092 disclose a number of predecessor implosion protection systems for a bulb of such character.

U.S. Pat. No. 2,222,197 to Engels discloses a CRT in which the bulb comprises a flangeless faceplate inset in an expanded open end of a cooperating funnel. A band allegedly providing implosion protection surrounds the outside of the funnel near the open end thereof.

The above-described prior art systems have met the industry's implosion protection needs for many years. Yet, it is believed that they do not represent the ultimate in implosion protection and cost effectiveness. As a whole, they represent a substantial burden on the cost and/or bulk of a color CRT. With a few exceptions, the prior art systems offer little or no protection of the fragile funnel and faceplate prior to the time they are assembled.

OBJECTS OF THE INVENTION

It is an object of the present invention to provide for a color television picture tube bulb with an implosion protection feature which is comparatively low in cost, extremely compact and yet effective in protecting the bulb against implosion.

It is another object to provide color CRT bulb and bulb components which are implosion protected by a system which, in one embodiment, abstracts the best of both rimbond and tension band systems without also having the drawbacks of either.

It is yet another object to provide funnel and faceplate color CRT components which are resistant to chipping and other handling-related damage.

It is still another object to provide a color CRT bulb which is implosion protected not only upon final assembly, but also during preliminary processing operations, thus reducing "shrinkage" (losses due to rejects) and increasing safety during tube manufacture.

BRIEF DESCRIPTION OF THE DRAWINGS

The features of the invention which are believed to be novel are set forth with particularity in the appended claims. The invention, together with further objects and advantages thereof, may be best understood, however, by reference to the following description taken in conjunction with the accompanying drawings, and in which:

DESCRIPTION OF THE PREFERRED EMBODIMENTS

This invention is directed to the provision of improved implosion-protected color CRT bulb and bulb components.

Figure 1:
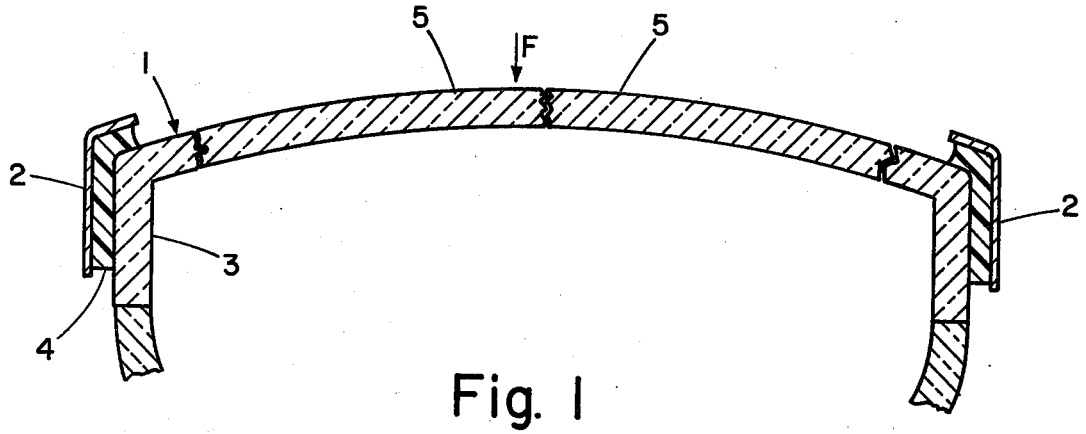
Fig. 1 PRIOR ART
FIGS. 1-3 depict two basic prior art implosion protection approaches.
Figure 2:
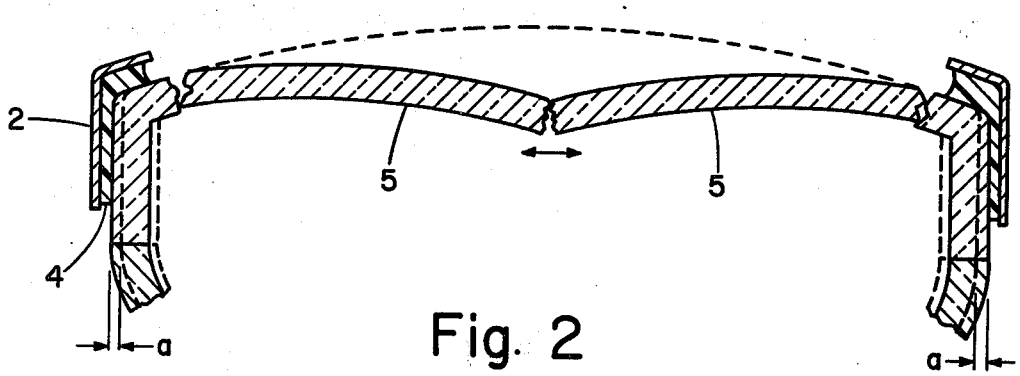
Fig. 2 PRIOR ART
Figure 3:
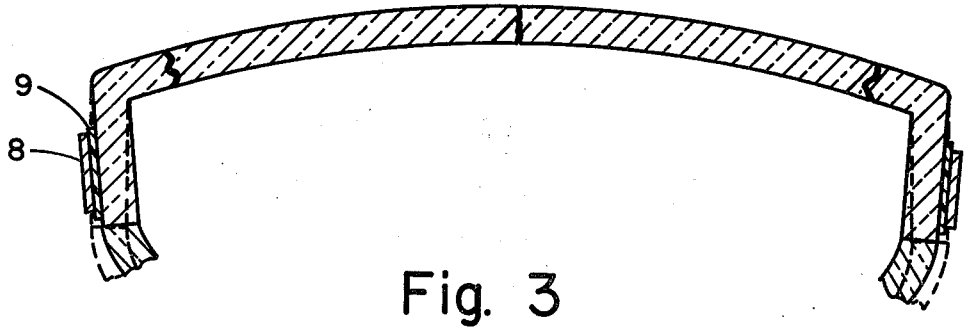
Fig. 3 PRIOR ART
Figures 4, 5, 6:
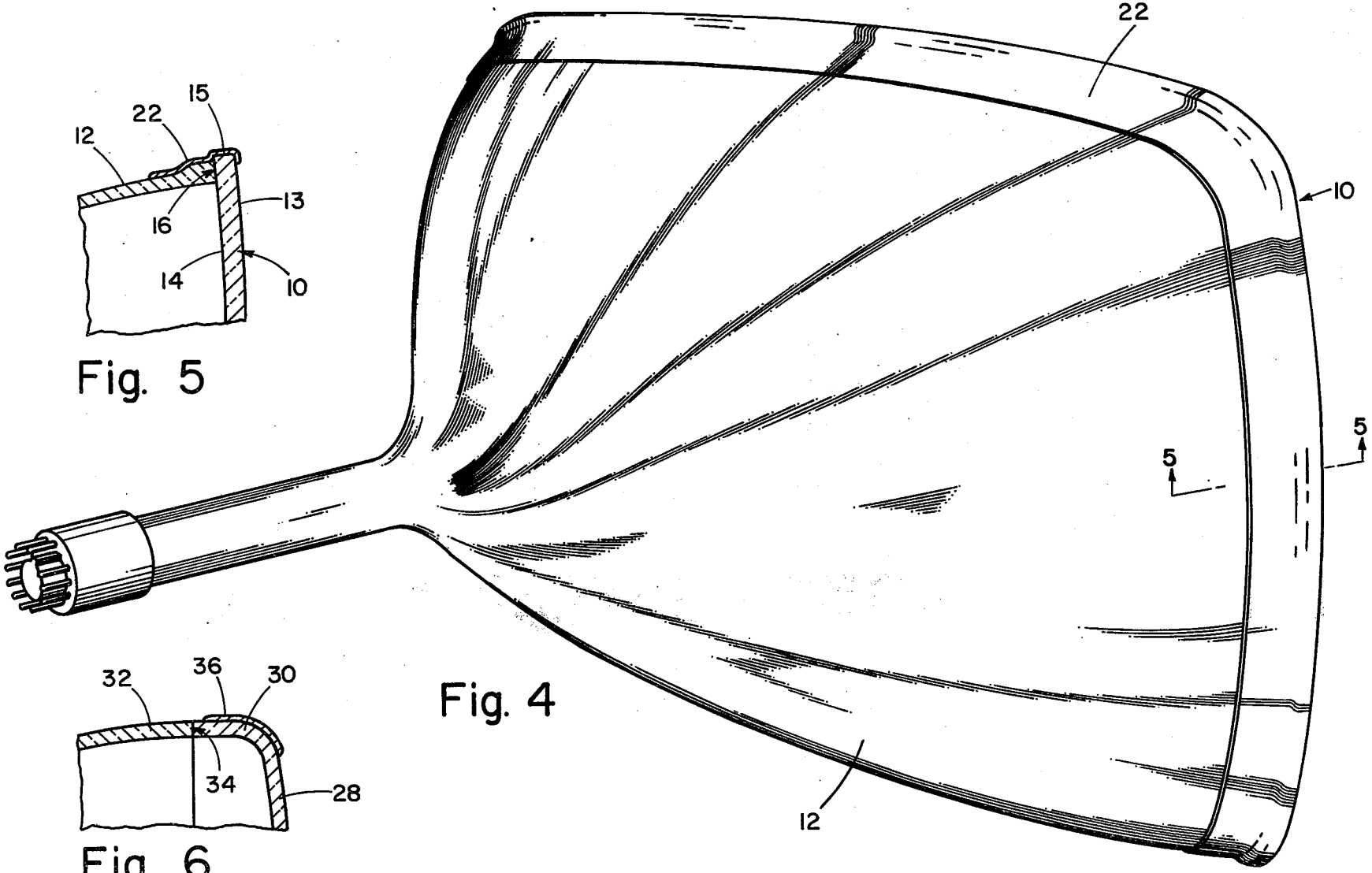
FIG. 4 is a schematic rear perspective view of a color cathode ray tube embodying the present invention.
FIG. 5 is a section view taken along lines 5—5 in FIG. 4.
FIG. 6 is a sectional view similar to FIG. 5, but depicting an alternative embodiment of one aspect of the present invention.

Briefly, a color tube to which this invention may be advantageously applied is illustrated schematically in FIGS. 4–5. The tube has an envelope or bulb comprising a flangeless faceplate 10 sealed to a funnel 12. The faceplate 10 has a three-dimensionally curved configuration which may be spherical, multiradial, cylindrical, or of other suitable curvature. The faceplate 10 has a convex front surface 13, a concave rear surface 14, and a hill-and-dale edge surface 15 between the front and rear surfaces of the faceplate.

The funnel 12 has a convex seal land lying in an imaginary curved surface corresponding to that of the concave rear surface 14 of the faceplate 10. The seal land of the funnel 12 is hermetically bonded to the rear surface 14 of the faceplate along a sealing interface 18, by means of a devitrifying glass cement, commonly termed a "frit" material.

The faceplate 10 is illustrated as being slightly larger than the mouth of the funnel 12, resulting in a slight overhang of the faceplate over the funnel. Alternatively, the faceplate edge surface 15 may be flush with the outside surface of the mouth of the funnel 12.

In accordance with this invention the bulb has a particle-deposited, form-fitting, high tensile strength metal bondment 22 engirding and self-adhered integrally to the bulb at or near the sealing interface 18. In the illustrated embodiment the bondment 22 is shown as overlying a marginal portion of the mouth of the funnel 12, the sealing interface 18 between the faceplate 10 and funnel 12, the edge surface 15 of the faceplate 10, and a marginal portion of the front surface 13 of the faceplate 10.

A self-adhered metal bondment, as described herein, is intended to mean a metal structure which is built up particle by particle upon a substrate surface and which adheres to the substrate without the use of a separate adhesive or cement. In accordance with this invention the metal bondment engirds the bulb and, in preferred embodiments thereof, is self-adhered integrally to the outer surface of the bulb so as to become one therewith. Due to the self-adherence of the metal bondment intimately and integrally to the bulb surface, any implosion-induced moments or loads, whether they be radial, axial or tangential, exerted by the shards of a fractured bulb during an implosion are transferred with little or no loss directly to the bondment.

As pointed out above, this is not true in prior art implosion protection systems of either the confinement type (typified by the "rimbond" systems) or the compressive pre-load type, typified by the tension band systems. The rimbond type systems necessarily utilize a cement, typically an epoxy cement, to transfer the stiffness and strength of the frame to the bulb and to assist in restraining the movement of the glass shards by virtue of the surface bonding properties of the cement. As noted above, the epoxy cements, having a relatively low modulus of elasticity compared to the frame material, act somewhat like a cushion and do not transfer loads imposed by the shards to the frame as effectively as desired. Secondly, the surface bonding properties of epoxy cement are not as great as desired, particularly as the epoxy ages.

By contrast, the metal bondment of the present invention, in a preferred embodiment, effects a very strong structural load and stress coupling between the bulb and bondment. The afore-described drawbacks regarding the weak transfer or coupling of loads and stresses between the bulb and external confining member does not exist in the present invention.

As stated above, the stiffness and strength of any implosion confining member and the resistance of the member to deformation during implosions is also extremely important. In accordance with this invention, the bondment 22 is composed of a material having a high yield strength and Young's modulus. It is built up by particle deposition until it has such cross-sectional dimensions that it has sufficient strength and stiffness to provide implosion protection for the bulb by confining and restraining the shards of a fractured bulb. The dimensions of the bondment, particularly the cross-sectional dimensions, are dictated by the application, the tube size and configuration, and the required strength. For the tube shown in FIGS. 4 and 5, the bondment, as described, may cover part of the periphery of the funnel, the sealing interface between the funnel and faceplate 12, and at least the edge surface 24 of the faceplate 10. It may be found, however, that a lesser coverage of the bulb will provide adequate implosion protection.

Although the principles of the invention are applicable to color cathode ray tubes of many types, it is thought to be particularly applicable to tubes of the nonconventional character shown in FIGS. 4 and 5 which do not have a rearwardly extending flange upon which either a rimbond frame or a tension band can be mounted. The invention, however, is applicable to tubes of the conventional type having a rearwardly extending flange. A fragmentary sectional view of an application to such a conventional tube is shown in FIG. 6. In FIG. 6 the portion of the bulb shown includes a faceplate 28 having a rearwardly extending flange 30. The faceplate is sealed to a funnel 32 along a planar sealing interface 34. In the FIG. 6 embodiment, a metal bondment 36 according to this invention engirds and is self-adhered integrally to a peripheral area of the flange 30 of the faceplate 28. Whereas in this embodiment, the bondment is shown as engirding only the faceplate, it could as well be extended over the sealing interface 34 or even further so as to overlie a marginal portion of the mouth of the funnel 32 adjacent the sealing interface.

The bondment (22 in FIGS. 4–5 and 36 in FIG. 6) will provide some implosion protection if the bondment has little or no tension in it and therefore exerts little or no compressive pre-loads on the bulb. In accordance with a preferred execution of this invention however, the bondment is caused to tensively engird the bulb such that it constricts the bulb and compressively preloads the bulb to achieve the beneficial implosion protection effects of bulb pre-load. With the bondment in intimate structural coupling to the bulb, the implosion protection afforded by the bondment will be enhanced. Pre-load may be achieved by methods herein later described.

One of the drawbacks of prior art implosion protection systems is that they are not installed until the tube fabrication process is nearly completed. After the faceplate and funnel have been sealed together and the assembled bulb has been evacuated, the bulb is said to be "live", that is, capable of imploding. If an implosion should occur in the factory after the bulb has been evacuated and before implosion protection has been provided, there exists a hazard to the safety of factory personnel. Secondly, the likelihood of an implosion occurring in the interim period is somewhat increased. In accordance with one aspect of this invention a part, or all, of the implosion protection for the bulb may be applied before the bulb is sealed and evacuated. More specifically, a bondment of the type described above can be applied to either the faceplate or to the funnel, or both, while they exist as separate components. This means that when the faceplate and funnel are sealed and the bulb is evacuated, the bulb already has extant its implosion protection system, or at least a part of it.

It is contemplated that even though a bondment may be applied to the faceplate and/or the funnel prior to sealing and evacuation of the bulb, it may be desirable for enhanced implosion protection to apply a further bondment which would overlap the sealing interface between the funnel and faceplate for enhanced implosion protection.

Figure 7:
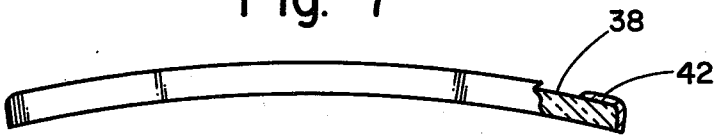
Figure 8:
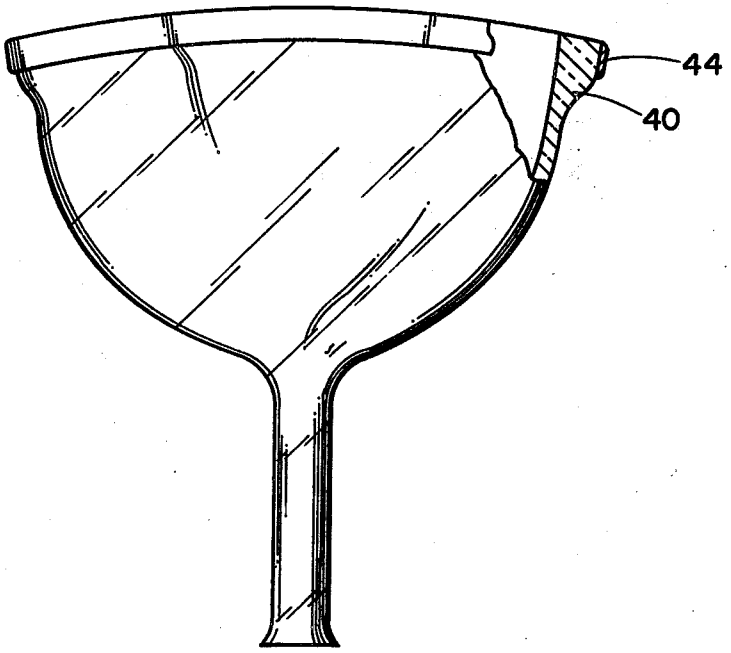

FIGS. 7 and 8 illustrate a faceplate 38 and a funnel 40 of the afore-described nonconventional type having metal bondments 42, 44, respectively, formed thereon while the faceplate and funnel exist as separate components prior to their assembly and sealing.

Figure 9:
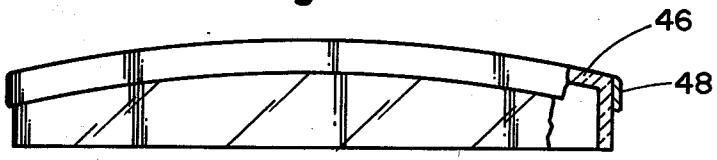
FIGS. 7-10 are schematic views of color bulb components embodying the present invention.
Figure 10:
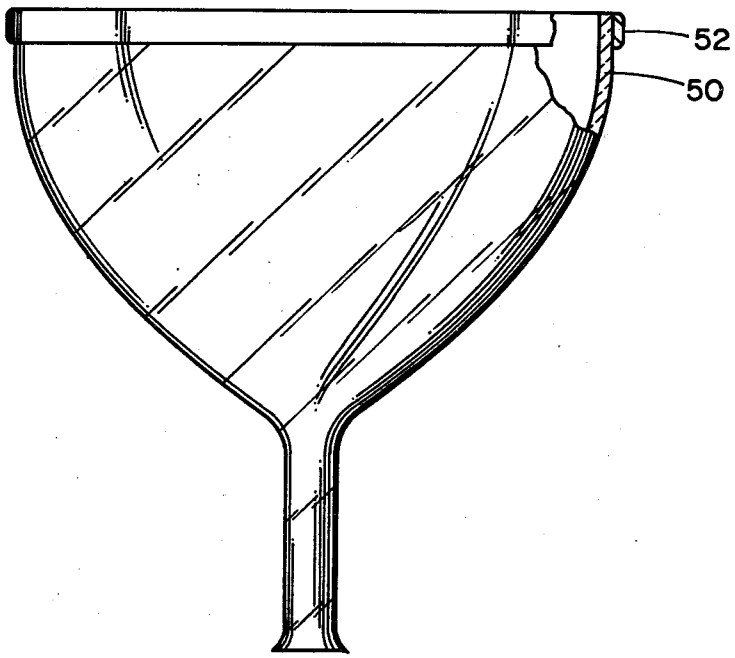

FIG. 9 illustrates a faceplate 46 of the conventional type having a rearwardly extending flange. The faceplate has a bondment 48. FIG. 10 is a mating funnel 50 on which is formed a bondment 52. It can be seen that when the faceplate 38 and funnel 40, or the faceplate 46 and funnel 50 are sealed and evacuated, the resulting bulb immediately has substantial implosion protection.

The provision of a bondment on the faceplate and/or funnel components as they exist separate from an assembled bulb has a number of other attributes. Chipping and other handling-related damage to these fragile glass components is reduced, thus decreasing the losses of these parts. Since glass is a "notch-sensitive" material (a material which is greatly weakened by a surface or edge scratch or the like), the provision of a bondment on the funnel and/or faceplate components at or soon after they are formed, has the advantage of reducing the cracking, chipping or otherwise marring of the surface of these components and thus reducing the number of failures of these components or the end-product bulbs into which they are assembled.

A preferred method for forming a bondment according to this invention will now be described. In the forming of a bondment on a sealed and evacuated bulb, after the sealing of the faceplate and funnel has been accomplished, the form-fitting bondment is built up by particle deposition in a region of the bulb at or near the sealing interface between the funnel and faceplate, preferably such that the bondment is self-adhered integrally to the bulb. The particle deposition is continued until the bondment has strength rendering it effective in implosion protecting the bulb.

Although a number of particle deposition methods may be employed, the method preferably used is that of flame-spraying. As used herein the term "flame-spraying" is intended to encompass any method wherein a material is brought to a molten state and atomized or particulated and projected onto the surface to be coated. The term "flame-spraying" is commonly used in one sense to refer to a process carried out by the use of a high temperature combustion nozzle into which is fed compressed air and combustible gases and the material to be melted and atomized. The nozzle effects a melting of the material, its atomization, and projection onto the surface to be coated. Typically the combustible gas is oxy-acetylene or oxy-propane. Any material which can be melted by an oxy-acetylene flame can be flame-sprayed. The flame-spraying process is well known in the art, having been used extensively for a number of decades. A large number of companies are engaged in the supply of flame spraying apparatus and/or services. The spray can be controlled with a high degree of accuracy and the results can be closely duplicated. There is no limit, in theory, to the thickness of the coating which can be deposited. A great variety of materials, preferably metals and metal alloys, in homogeneous and/or multi-layered structures, could be used depending on the application and the desired properties of the end product bondment.

In another type of flame-spraying, the material to be sprayed is in powder form. The powdered material is held in a hopper above the spray gun and is fed into an oxy-acetylene-fired nozzle. An aspirator jet arranged in the nozzle projects the melted and atomized particles onto the substrate to be coated.

Still another flame-spray process is sometimes termed a "plasma flame-spray process". It differs from the aforedescribed processes primarily in that an electric arc rather than combustion of a gas fuel is used to generate the very high temperatures needed to melt the material to be sprayed. It receives the material to be sprayed in powder form. The plasma flame-spray process is said to be less expensive and safer than the processes which use an oxy-acetylene flame or other combustion process to generate the high heat required. The plasma flame-spray process can generate in the arc temperatures up to 30,000° F., a temperature which is very adequate to liquify any of the materials which one might wish to deposit.

A fourth flame spray type process which may be employed is sometimes termed a "detonating gun" process. This process is another combustion-type process but utilizes a spark plug to periodically ignite the combustible gases. The detonation gun-type flame spray process is utilized where high particle velocities are desired.

Figure 11:
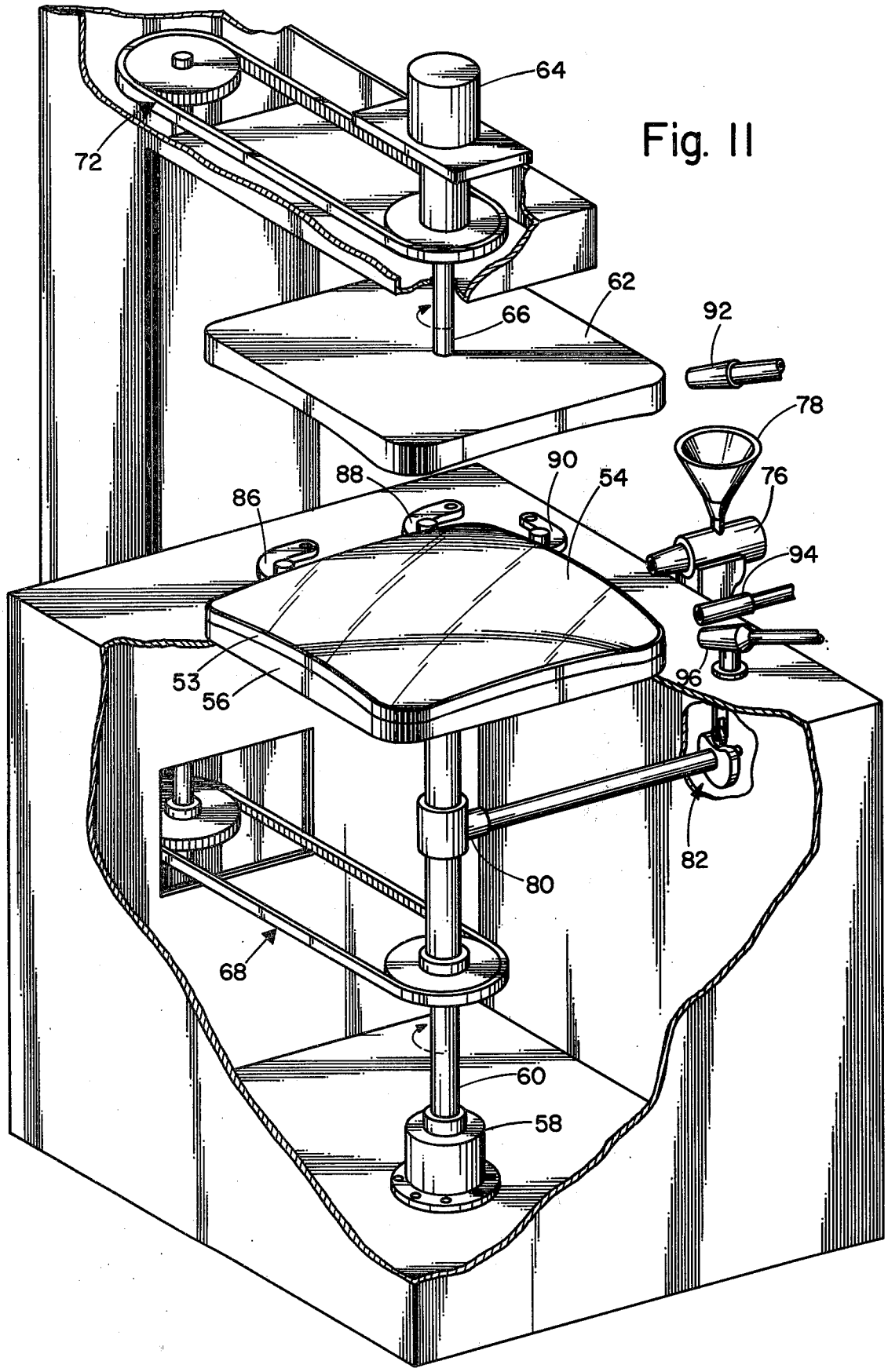
FIG. 11 is a schematic view of apparatus which may be employed to carry out a method of implementing the present invention.

FIG. 11 illustrates in highly schematic form apparatus which might be employed according to this invention to form a bondment on a color cathode ray tube bulb or bulb component. FIG. 11 shows an application for depositing a bondment 53 upon a faceplate 54 of the nonconventional flangeless type. The FIG. 11 apparatus is illustrated as including a support 56 on which the faceplate 54 rests. The support 56 is rotated by a drive assembly 58 and shaft 60. A shroud 62 is lowered onto the panel before flame spraying of the edge surface of the faceplate 54 by means of an air cylinder 64 and shaft 66. The shroud is rotated in synchronism with the panel through belt drives 68, 70 and interconnecting shaft 72. A flame-spray gun 76, which may be of any of the above-described types, has a hopper 78 for permitting gravity feed to the gun 76 of a powdered material to be deposited. The gun is fed, in the illustrated embodiment, by compressed air and oxygen and acetylene (feed conduits not shown).

A 90° drive 80 and a cam-cam follower assembly 82 raises and lowers the gun in order that the sprayed particles will be deposited on the serpentine edge surface of the faceplate 54. Retractable arms 86, 88 and 90 position the faceplate and then swing out of the way. Air cooling jets 92,94 and 96 cool the shroud 62, the deposited bondment 53, and the support 56, respectively.

A hood for the apparatus would normally be employed to carry away the generated heat and combustion products, but is not shown here in order to more clearly depict the flame-spraying apparatus.

Whereas it may be possible to flame spray the bondment 53 directly upon a faceplate maintained at room temperature, it is believed to be advantageous to preheat the faceplate 54, e.g. to 300°–400° C. for example.

After elevating the temperature of the faceplate 54, preferably in a separate oven such as the frit seal oven or exhaust (evacuation) oven, a form-fitting metal bondment is flame-sprayed about the circumference of the faceplate. The bondment is deposited at a temperature which is at least as high as the temperature of the faceplate. The deposition continues until the bondment has such cross sectional dimensions which, considering the yield strength and Young's modulus of the material used to form the bondment, causes the bondment to be effective to provide implosion protection for a bulb into which the faceplate is assembled by confining and restraining shards of a fractured faceplate. The bulb and its bondment are then brought to a common lower temperature. The bondment is preferably formed of a metal having a higher coefficient of thermal expansion than of the glass faceplate such that the bondment at the lower temperature constricts and compressively pre-loads the faceplate, contributing further to the implosion protection provided thereby. Whereas this method has been described in connection with the formation of an implosion protection bondment on a faceplate, the same or a similar method can be used to apply a bondment to a funnel or to a bulb.

Although numerous materials may be deposited to form the bondment, it is believed that metals have the most favorable properties. In particular, mild steel is preferred from the standpoint of cost, temperature coefficient of expansion and other properties. Other materials which may be employed are various stainless steel alloys, nickels, nickel-irons or any metal having the desireable characteristics of strength, stiffness, expansion, etc. It is believed that a bondment having a thickness of approximately 30–50 mils and a width of approximately 1–3 inches will provide a high degree of implosion protection and will also offer the aforedescribed resistance to chipping and other handling-induced damage prior to assembly into a bulb.

If the bondment is applied while the faceplate is hot, then an essentially zero stress condition between bondment and the glass substrate exists at that temperature. Upon cooling of the combination, if the bondment has a higher coefficient of thermal expansion than the glass, the bondment will go into tension and the glass into compression. The net effect is to strengthen the glass against implosion induced tensive stresses and thereby increase its resistance to implosion. If the bulb or bulb component should be subsequently elevated in temperature, the glass will never be placed in tension (a condition in which it is quite weak) unless the temperature at which the bondment was applied is exceeded.

In another method, the deposited material may be selected to have a temperature coefficient of expansion which is about the same as that of the glass. This has the advantage of minimizing the possibly deleterious shear stresses between the bondment and the glass, however in this execution the bondment will not exert significant compressive pre-loads on the bulb or bulb component. The amount of tension resulting in the bondment at room temperature, and thus the degree of compressive pre-loading of the faceplate can be selected by appropriate selection and control of the glass and metal bondment materials, and the initial and final temperatures of the bondment and glass.

It may be desirable in certain applications to have the bondment surrounding the bulb or bulb component but with little or no surface adherence, but nonetheless with intimate contact. Such an approach could still provide effective structural coupling while minimizing the possibly undesirable effects of high local shear stress. This condition may be achieved by applying a release agent to the glass substrate before the metal bondment is deposited.

In yet another application, depending on the properties of the glass substrate and/or the metal to be deposited, it may be desirable to deposit a rigid underlying coating which improves the adherence of the bondment to the glass, or improves the properties of the end product bondment, or otherwise improves the end product implosion protection system.

One of the advantages of the bondment according to this invention is that it is inherently nonslipping. This is not true of the frame used in rimbond systems nor of the tension band used in pre-load type systems. The inherent nonslipping of the frame comes from the fact that it is intimately bonded to become one with the glass bulb or bulb component or at least intimately form fitting to the bulb.

It may be desirable in certain applications to apply for example, a low cost mild steel layer which would provide the bulk of the strength and stiffness of the bondment. However because mild steel is very prone to rusting and corrosion during chemical salvage operations, it may be desirable to coat the steel surface with a protective layer such as nickel. Beneath the mild steel layer might be first deposited a layer of nickel-aluminide molybdenum, or some other rigid bonding agent to improve the bond of the steel to the glass.

While particular executions of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. As a separate component existing prior to assembly into a color cathode ray tube bulb, a glass faceplate having on its outside surface a central viewing area and a peripheral area surrounding the viewing area, said faceplate being characterized by having a flame-sprayed high tensile strength, microscopically form-fitting bondment engirding said peripheral area of said faceplate surface, said bondment being composed of a metal having a high yield strength and Young's modulus and being built up, particle-by-particle, to such cross-sectional dimensions as to have sufficient strength and stiffness to provide implosion protection for the bulb when the faceplate is assembled as part of a completed and evacuated bulb, said bondment also protecting the faceplate against handling-induced damage prior to assembly of the faceplate into a bulb.

2. The faceplate defined by claim 1 wherein said faceplate is flangeless and said peripheral area is a hill-and-dale edge surface of said faceplate.

3. The faceplate defined by claim 1 wherein said faceplate has a rearwardly extending flange and said peripheral area includes the outside surface of said flange.

4. As a separate component existing prior to assembly into a color cathode ray tube bulb, a glass faceplate having on its outside surface a central viewing area and a peripheral area surrounding the viewing area, said faceplate being characterized by having a flame-sprayed, high tensile strength, microscopically form-fitting and intimately structurally coupled bondment tensively engirding and self-adhered integrally to said peripheral area of said faceplate surface so as to become one therewith, said bondment being composed of a metal having a high yield strength and Young's modulus and being built up, particle-by-particle, to such cross-sectional dimensions as to have sufficient strength and stiffness to provide implosion protection when the faceplate is assembled as part of a completed and evacuated bulb by conjointly applying a compressive pre-load to the faceplate and confining and restraining the shards of a fractured faceplate, said bondment also protecting the faceplate against handling-induced damage prior to assembly of the faceplate into a bulb.

5. As a separate component existing prior to assembly into a color cathode ray tube bulb, a glass funnel characterized by having a flame-sprayed, microscopically form-fitting, high tensile strength bondment composed of a metal having a high yield strength and Young's modulus, said bondment engirding said funnel at or near its mouth and being built up, particle-by-particle, to such cross-sectional dimensions as to have sufficient strength and stiffness to provide implosion protection when the funnel is assembled as part of a completed and evacuated bulb, said bondment also protecting the funnel against handling-induced damage prior to assembly of the funnel into a bulb.

6. As a separate component existing prior to assembly into a color cathode ray tube bulb, a glass funnel characterized by having a flame-sprayed, high tensile strength, microscopically form-fitting and intimately structurally coupled bondment composed of a metal having a high yield strength and Young's modulus, said bondment tensively engirding said funnel at or near its mouth so as to become one therewith, said bondment being built up, particle-by-particle, to such cross-sectional dimensions as to have sufficient strength and stiffness to provide implosion protection when the funnel is assembled as part of a completed and evacuated bulb by conjointly applying a compressive pre-load thereto and confining and restraining the shards of a fractured funnel, said bondment also protecting the funnel against handling-induced damage prior to assembly of the funnel into a bulb.

7. An implosion-protected color cathode ray tube bulb, comprising a glass faceplate hermetically sealed to a glass funnel along a sealing interface, said bulb being characterized by having a flame-sprayed, high tensile strength, microscopically form-fitting bondment composed of a metal having a high yield strength and Young's modulus, said bondment engirding said bulb at or near said sealing interface and being built up, particle-by-particle, to such cross-sectional dimensions as to have sufficient strength and stiffness to provide implosion protection for the bulb by confining and restraining the shards of a fractured bulb.

8. An implosion-protected color cathode ray tube bulb, comprising a glass faceplate hermetically sealed to a glass funnel along a sealing interface, said bulb being characterized by having a flame-sprayed, high tensile strength, microscopically form-fitting and intimately structurally coupled bondment composed of a metal having a high yield strength and Young's modulus, said bondment engirding and being self-adhered to said bulb at or near said sealing interface so as to become one therewith and being built up, particle-by-particle, to such cross-sectional dimensions as to have sufficient strength and stiffness to provide implosion protection for the bulb by confining and restraining the shards of a fractured bulb.

9. An implosion-protected color cathode ray tube bulb, comprising a glass faceplate hermetically sealed to a glass funnel along a sealing interface, said bulb being characterized by having a flame-sprayed, high tensile strength, microscopically form-fitting and intimately structurally coupled bondment composed of a metal having a high yield strength and Young's modulus, said bondment tensively engirding and being self-adhered to said bulb at or near said sealing interface so as to become one therewith, and being built up, particle-by-particle, to such cross-sectional dimensions as to have sufficient strength and stiffness to provide implosion protection for the bulb by conjointly applying a compressive pre-load thereto and confining and restraining the shards of a fractured bulb.

* * * * *